US005419019A

United States Patent [19]

Ida

[11] Patent Number: 5,419,019

[45] Date of Patent: May 30, 1995

[54] AUTOMATICALLY LOCKING SLIDER FOR SLIDE FASTENERS

[75] Inventor: Kazuo Ida, Toyama, Japan

[73] Assignee: Yoshida Kogyo K.K., Tokyo, Japan

[21] Appl. No.: 192,832

[22] Filed: Feb. 7, 1994

[30] Foreign Application Priority Data

Feb. 26, 1993 [JP] Japan ..... 5-038581

[51] Int. Cl.[6] ..... A44B 19/30

[52] U.S. Cl. ..... 24/421

[58] Field of Search ..... 24/420–422

[56] References Cited

U.S. PATENT DOCUMENTS

| | | | |
|---|---|---|---|
| 2,764,807 | 10/1956 | Dorman . | |
| 3,945,090 | 3/1976 | Fukuroi . | |
| 3,991,447 | 11/1976 | Akashi . | |
| 4,055,876 | 11/1977 | Ackermann et al. | 24/421 |
| 4,644,613 | 2/1987 | Kedzierski | 24/421 |

FOREIGN PATENT DOCUMENTS

| | | | |
|---|---|---|---|
| 0365910 | 5/1990 | European Pat. Off. . | |
| 2174848 | 10/1973 | France . | |
| 2911119 | 10/1979 | Germany | 24/421 |
| 42-13148 | 7/1967 | Japan . | |
| 44-19285 | 3/1969 | Japan . | |
| 46-4268 | 2/1971 | Japan . | |
| 46-4269 | 2/1971 | Japan . | |
| 61-20505 | 1/1986 | Japan . | |
| 61-82702 | 4/1986 | Japan . | |
| 62-39707 | 10/1987 | Japan . | |
| 63-33528 | 9/1988 | Japan . | |
| 572718 | 2/1976 | Switzerland . | |
| 1377451 | 12/1974 | United Kingdom . | |

*Primary Examiner*—James R. Brittain

*Attorney, Agent, or Firm*—Hill, Steadman & Simpson

[57] ABSTRACT

An automatically locking slider for slide fasteners is formed from a moldable plastics material and provided with an integral multi-leg locking structure including a spring portion, a locking prong portion and an anchoring portion. The spring portion is relatively short in length and has at one of its ends a bulged or ball-like projection extending outwardly beyond the region of the locking prong portion for abutting engagement with the inner wall of a cap.

5 Claims, 2 Drawing Sheets

AUTOMATICALLY LOCKING SLIDER FOR SLIDE FASTENERS

BACKGROUND OF THE INVENTION

1. Field of the Invention

This invention relates to a slider for slide fasteners and has particular reference to such a slider which can lock itself automatically upon the slide fastener.

2. Prior Art

There are known a great many automatically lockable sliders adapted to open and close slide fasteners or zippers applied to various garment articles. The majority of conventional automatically locking sliders are fabricated from a metallic material and provided with locking means comprising a locking member and a resilient member typically in the form of a leaf spring, the two members being separately accommodated within a cap-like housing over a slider body. Assembling such sliders is rather tedious, as the resilient member is required to be carefully held in abutting engagement with the inner wall of the housing and accurately positioned relative to the locking member to ensure proper operation of the latter.

Advanced sliders of the automatic type are disclosed in Japanese Utility Model Publications Nos. 46-4268 and 46-4269 in which the slider is provided with a leaf spring integrally joined at one end to a locking member and folded back toward the opposite end to bear against the upper inner wall of a casing. Although this leaf spring is integrally formed with the locking member, it is elongated such that its resilient strength is reduced, leading to malfunctioned locking operation of the slider.

A common problem with automatic locking sliders incorporating metallic leaf springs is that they are costly due to the use of relatively expensive resilient material.

SUMMARY OF THE INVENTION

With the foregoing difficulties of the prior art in view, the present invention seeks to provide an automatically locking slide for slide fasteners which is made of a moldable synthetic resin.

The invention also seeks to provide an automatically locking slider for slide fasteners incorporating structural features such that a locking member can be supported stably in position against displacement relative to the slider body and can perform its locking action effectively with the aid of adequate spring action.

According to the invention, there is provided an automatically locking slider for slide fasteners which is formed from a moldable plastics material and which comprises a slider body having an upper shield and a lower shield spaced apart in parallel and interconnected at one of their ends by a connecting head to define therebetween a guide channel; a pull tab having a pintle pivotally supported on said upper shield; a locking member for releasably locking the slider with respect to the fastener; and a cap secured to said upper shield and encasing said locking member, said locking member comprising an integral multi-leg structure including a spring portion having a relatively short arcuate arm with a bulged end, a locking prong portion having a locking prong and a reduced neck merging with said arm and engageble with said pintle and an anchoring portion remote from said locking prong for anchoring said locking member relative to said slider body.

The above objects and features of the invention will be better understood from the following detailed description taken in connection with the accompanying drawings illustrating by way of example a preferred embodiment.

DETAILED DESCRIPTION OF THE INVENTION

Figure 1:
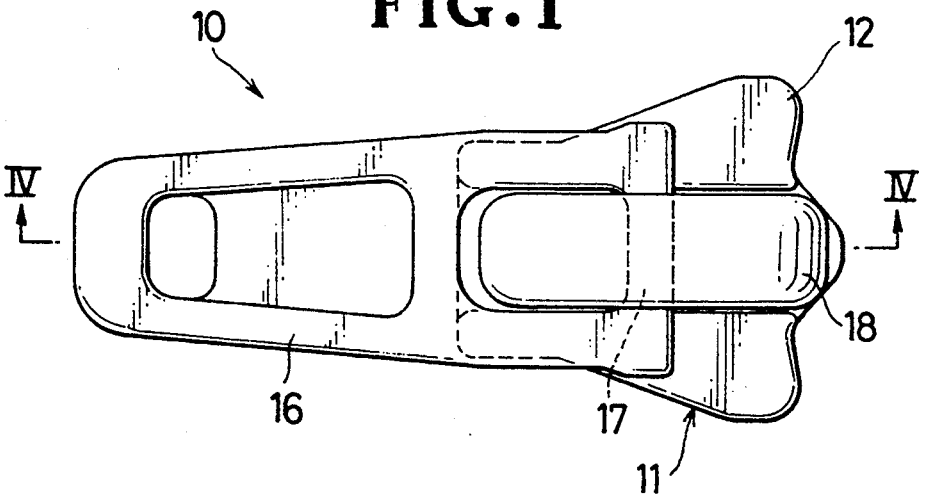
FIG. 1 is a plan view of a slider embodying the invention.

A slide fastener slider generally designated at 10 constructed in accordance with the principles of the invention comprises a slider body 11 having an upper shield 12 and a lower shield 13 spaced apart in parallel and interconnected at one of their ends by a connecting head 14 commonly known as a diamond to define therebetween a guide channel 15 for the passage therethrough of a pair of fastener stringers (not shown) in a manner well known in the art.

Designated at 16 is a pull tab with which to move the slider 10 in one direction to close and in the opposite direction to open the fastener also in a manner well known in the art. The pull tab 16 has a pintle 17 at one end pivotally supported on the upper shield 12 of the slider body 11 and operatively associated with a locking member later described.

Figure 4:
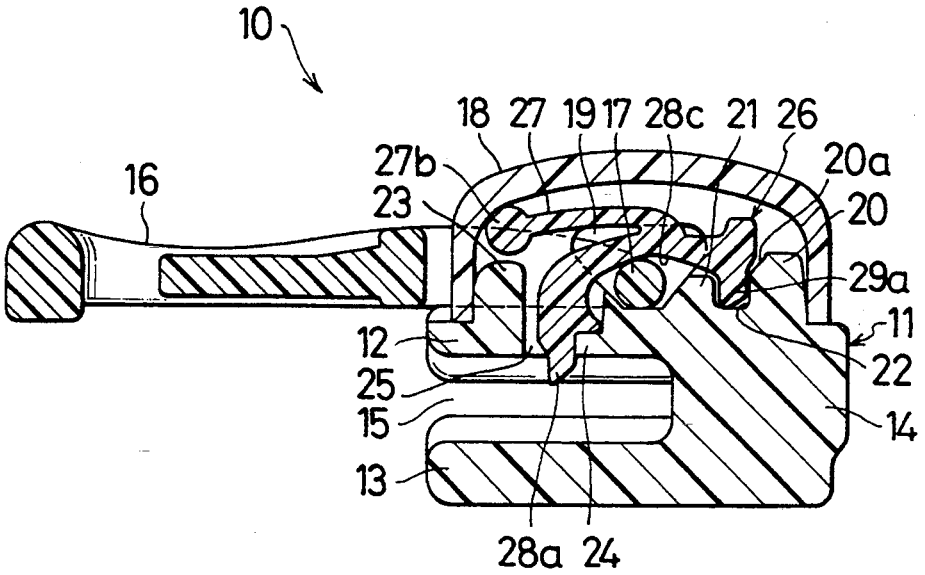
FIG. 4 is a longitudinal cross-sectioned view taken on the line IV—IV of FIG. 1.
Figure 5:
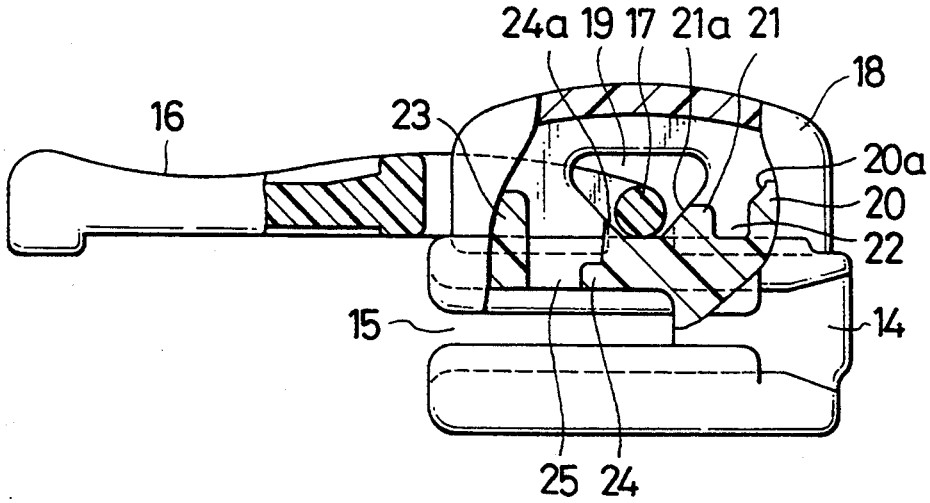
FIG. 5 is a side elevational, partly sectional, view of the slider with the locking member removed.

Designated at 18 is a cap or cover having its marginal peripheral edge secured to the upper surface of the upper shield 12 and adapted to encase the pintle 17 and the locking member as more clearly shown in FIG. 4. The cap 18 has a transverse through-opening 19 which is substantially in the form of an inverted triangle in cross-section with an apex directed toward the upper shield 12 and which is adapted to allow vertical displacement of the pintle 17 with respect to the upper shield 12.

The upper shield 12 of the slider body 11 is provided at one end with a first upwardly projecting lug 20 having a recessed inner wall **20*a* and a ridge 21, both being integrally formed with the head 14 and defining therebetween a support groove 22. The ridge 21 has a rear portion 21*a* remote from the guide groove 22 sloped in conformity with the downwardly converging side line of the triangular opening 19**.

The upper shield 12 is provided at the opposite end with a second upwardly projecting lug 23 remote from the first lug 20 and a stepped ledge 24 having a sloped portion **24*a* contiguous to and cooperating with the sloped portion 21*a* of the ridge 21 to limit horizontal displacement of the pintle 17 of the pull tab 16. The second lug 23 and the stepped ledge 24 jointly define therebetween a guide opening 25 communicating with the guide channel 15**.

Figure 2:
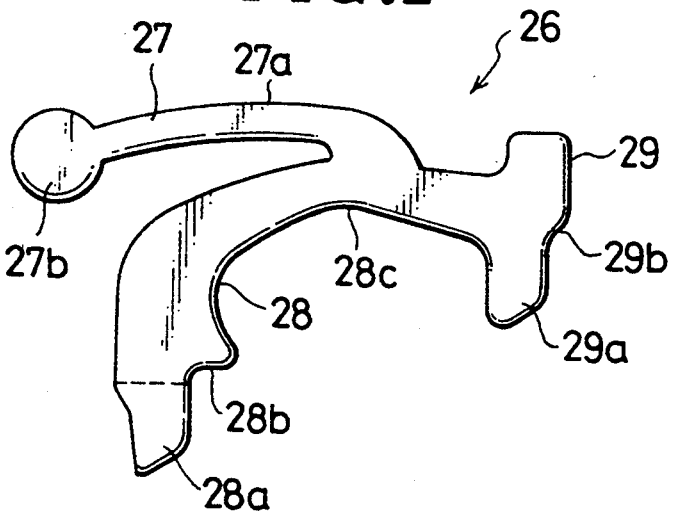
FIG. 2 is a side elevational view of a locking member of the slider.
Figure 3:
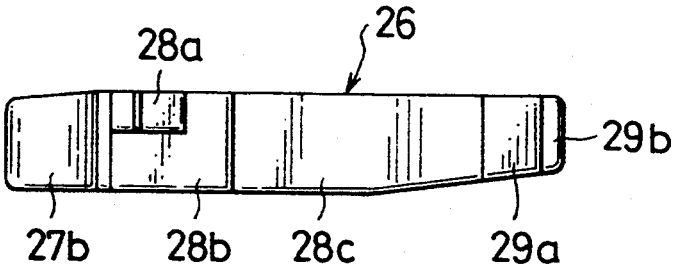
FIG. 3 is a bottom plan view of the locking member.

Designated at 26 is a locking member for releasably locking the slider 10 with respect to the fastener stringers. As better shown in FIG. 2, the locking member 26 is multi-legged in shape, comprising a spring portion 27, a locking prong portion 28 and an anchoring portion 29, all integrally formed. The locking prong portion 28 includes a locking prong 28*a* at one end movable through the guide opening 25 into and out of the guide channel 15 and a jaw 28*b* adjacent to the prong 28*a* abuttingly engageable with the stepped ledge 24 in the upper shield 12 of the slider body 11 to limit descending movement of the locking prong 28*a* toward the guide channel 15. The locking prong portion 28 is progressively tapered to provide a reduced neck 28*c* at the opposite end remote from the locking prong 28*a* for engagement with the pintle 17 when the pull tab 16 is lifted to move the locking prong 28 away from the guide channel 15.

The spring portion 27 includes an arcuate arm 27*a* having one of its end merged with the reduced neck 28*c* of the locking prong portion 28 and extending in overlying relation to the locking prong portion 28. The opposite end of the spring portion 27 is bulged as at 27*b*, forming a spherical ball significantly larger in dimension than the rest of the arm 27*a* and extending outwardly beyond the locking prong 28*a* for effective abutting engagement with the inner wall of the cap 18.

The anchoring portion 29 is merged with the spring portion 27 and the locking prong portion 28 and provided at the opposite end with a downwardly extending leg 29*a* supportedly received in the support groove 22 in the upper shield 12 of the slider body 11 to anchor the locking member 26 relative to the slider body 11 as shown in FIG. 4. A cam surface 29*b* is formed in the anchoring portion 29 adjacent to the leg 29*a* for abutting engagement with the recessed inner wall 20*a* of the first lug 20 when the pull tab 16 is lifted.

The spring portion 27 is relatively short in length so as to be able to impart sufficient resilient force to the locking prong portion 28 to ensure stable locking engagement of the locking prong 28*a* in the gap between adjacent coupling elements (not shown) of the fastener stringers when the pull tab 16 is released to lie flat against the slider body 11 as shown in FIG. 4. The engaging ball 27*b* of the locking member 26 provides increased area and of friction-free contact with the cap 18, thus assisting in positional stability of the locking member 26 between the cap 18 and the slider body 11.

With the various parts of the slider 10 assembled together as shown in FIG. 4, the pull tab 16 may be lifted about the pintle 17 against the tension of the spring portion 27 of the locking member 26 so that the locking prong 28*a* is retracted from the guide channel 15 to permit movement of the slider 10 in either direction in the well known manner. Releasing the pull tab 16 readily brings the locking prong 28*a* back into the passage of the fastener stringers in the guide channel 15 under the influence of storing resilient action of the spring portion 27, thereby automatically locking the slider 10 with respect to the fastener stringers.

Obviously, various modifications and variations of the present invention are possible in the light of the above teaching. It is therefore to be understood that within the scope of the appended claims the invention may be practiced otherwise than as specifically described.

What is claimed is:

1. An automatically locking slider for a slide fastener which is formed from a moldable plastic material and which comprises:

a slider body having an upper shield and a lower shield spaced apart in parallel and interconnected at one of their ends by a connecting head to define therebetween a guide channel;

a pull tab having a pintle pivotally supported on said upper shield;

a locking member for releasably locking the slider with respect to the fastener;

a cap secured to said upper shield and encasing said locking member, said locking member comprising an integral structure including a spring portion having a relatively short arcuate arm with a bulged end, a locking prong portion having a locking prong and a reduced neck merging with said arm and engageable with said pintle and an anchoring portion remote from said locking prong for anchoring said locking member relative to said slider body; and wherein said bulged end of said spring member is in the form of a spherical ball.

2. An automatically locking slider according to claim 1, wherein said bulged end extends forwardly beyond said locking prong.

3. An automatically locking slider according to claim 2, wherein said reduced neck is located intermediate between said locking prong and said anchoring portion for engagement with said pintle.

4. An automatically locking slider according to claim 6 wherein said locking member is formed from a moldable plastics material.

5. An automatically locking slider for a slide fastener which is formed from a moldable plastic material and which comprises:

a slider body having an upper shield and a lower shield spaced apart in parallel and interconnected at one of their ends by a connecting head to define therebetween a guide channel;

a pull tab having a pintle pivotally supported on said upper shield;

a locking member for releasably locking the slider with respect to the fastener;

a cap secured to said upper shield and encasing said locking member, said locking member comprising an integral structure including a spring portion having a relatively short arcuate arm with a bulged end, a locking prong portion having a locking prong and a reduced neck merging with said arm and engageable with said pintle and an anchoring portion remote from said locking prong for anchoring said locking member relative to said slider body; and wherein said bulged end extends forwardly beyond said locking prong.

* * * * *